United States Patent [19]

Miller

[11] 3,992,596

[45] Nov. 16, 1976

[54] FLASHLIGHT SWITCH HAVING REMOVABLY MOUNTED CONTACT TERMINAL SECURING STRUCTURE

[75] Inventor: Jack V. Miller, Sierra Madre, Calif.

[73] Assignee: Bianchi Leather Products, Inc., Temecula, Calif.

[22] Filed: June 30, 1975

[21] Appl. No.: 592,031

[52] U.S. Cl. ..... 200/60; 260/284; 240/10.66

[51] Int. Cl.[2] ..... F21V 23/04; H01H 1/00

[58] Field of Search ..... 200/16 R, 60, 284; 240/10.66

[56] References Cited

UNITED STATES PATENTS

| | | | |
|---|---|---|---|
| 1,333,919 | 3/1920 | Ile | 200/60 |
| 1,888,204 | 11/1932 | Stimson | 200/60 |
| 1,902,590 | 3/1933 | Shannon | 200/60 |
| 2,418,759 | 4/1947 | Crimmins | 200/60 |
| 2,420,585 | 5/1947 | Crimmins | 200/60 |
| 2,461,634 | 2/1949 | Doose | 200/60 |
| 2,464,184 | 3/1949 | Pearce | 200/60 X |
| 2,466,414 | 4/1949 | Gits et al. | 200/60 |
| 2,477,516 | 7/1949 | Haas | 200/60 |
| 2,564,612 | 8/1951 | Schneider | 200/60 |
| 2,599,295 | 6/1952 | Thomas | 200/60 |
| 2,730,586 | 1/1956 | Duetzmann | 200/60 |
| 2,852,634 | 9/1958 | Garland | 200/60 |
| 2,886,664 | 5/1959 | Graubner | 200/60 |
| 2,897,303 | 7/1959 | Engert | 200/60 |
| 2,900,493 | 8/1959 | Cheng | 200/60 X |
| 3,226,502 | 12/1965 | Scholtz | 200/60 |
| 3,851,126 | 11/1974 | Keller | 200/60 |

*Primary Examiner*—James R. Scott
*Attorney, Agent, or Firm*—John E. Wagner

[57] ABSTRACT

A slide switch designed to be attached to the barrel of the flashlight by a pair of screws which serve the further function of interconnecting the switch to the electrical circuit of the flashlight. The switch body is of insulating material. It includes a pair of side ears protecting the switch operator and a pair of screw holes through the body. Two leaf springs constituting the contact elements include reentrant tabs extending through the screw openings of the body whereby the reentrant tabs engage both the shank and the underside of the head of the mounting screws.

4 Claims, 9 Drawing Figures

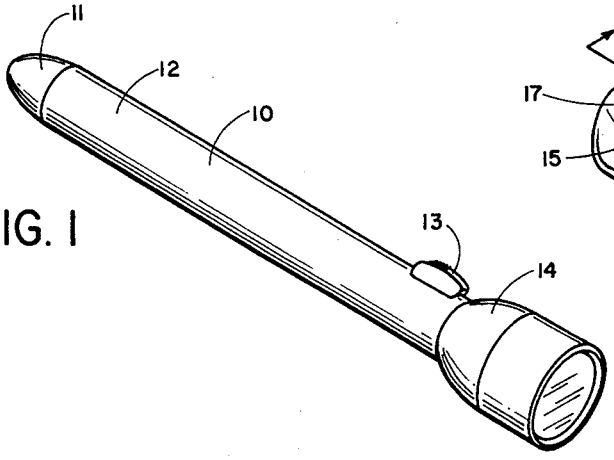
FIG. 1
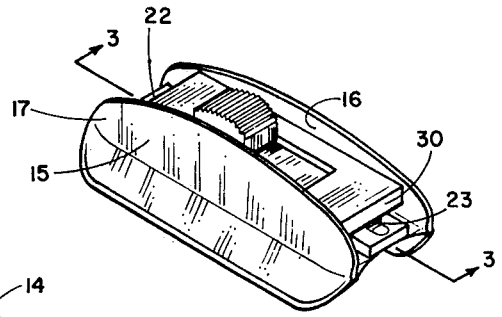
FIG. 2
FIG. 3
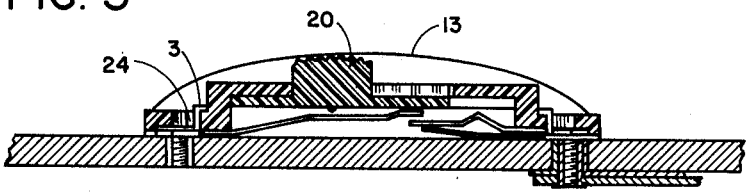
FIG. 4
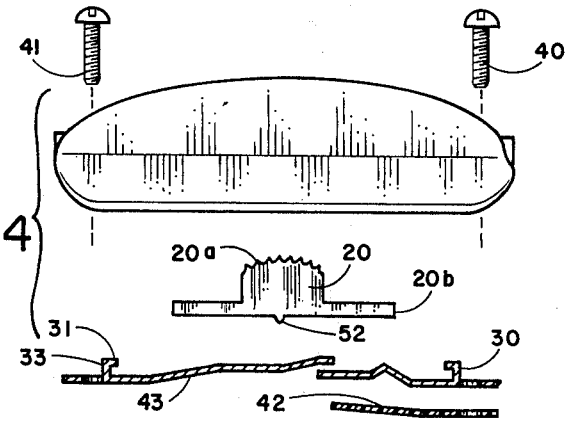
FIG. 5a
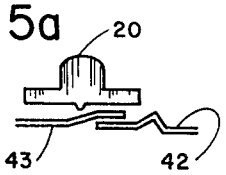
FIG. 5b
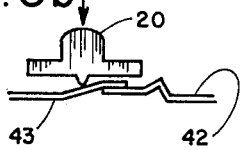
FIG. 5c
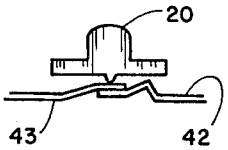
FIG. 6
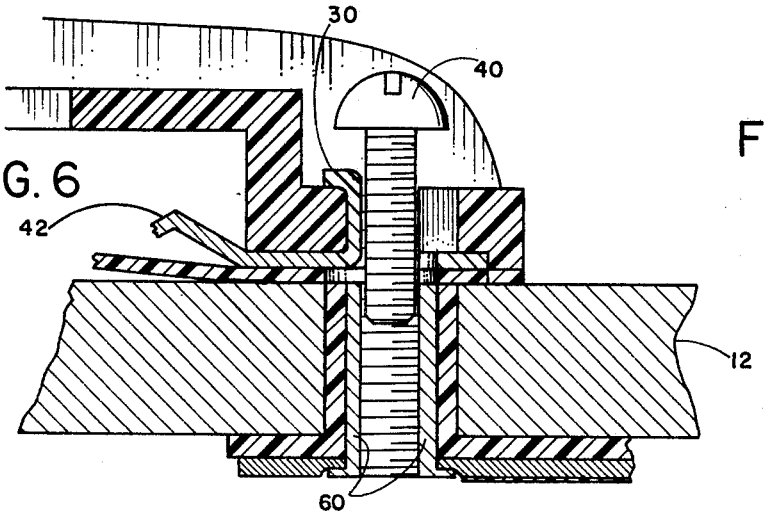
FIG. 7
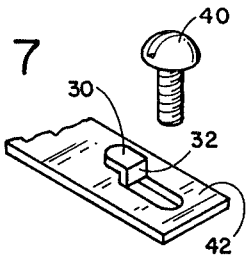

FLASHLIGHT SWITCH HAVING REMOVABLY MOUNTED CONTACT TERMINAL SECURING STRUCTURE

BACKGROUND OF THE INVENTION

Slide switches have long been used on flashlights to close the circuit between the power source and the lamp, usually by forward movement by the user's thumb. Characteristically these switches operate on either of two positions, ON or OFF, or three positions, ON, OFF or PRESS TO FLASH. In either of these versions, the slider usually includes protuberances which depress one overlying leaf spring into contact with the second. Various means have been used in the past to extend the electrical contact from the leaf springs onto the battery pack and the lamp. This has been done by electrical wire connections or flat conductors. In certain cases, the slider is directly mechanically connected to a movable electrical strap or buss member which is moved forward actually into direct physical contact with the electrical socket assembly for the lamp. In the case of metal body flashlights, the body itself can act as one of the conductors, usually from the base of the stack batteries through their retainer spring, the rear cap and the barrel, while the front contact of the slider switch must be insulated. It is desirable that the switch be assembled as a separate assembly from the flashlight, and when attached mechanically, the electrical connection completed as well. This, however, has not been effectively accomplished in the past.

BRIEF STATEMENT OF THE INVENTION

In accordance with this invention, a switch assembly has been developed by employing the minimum number of parts and each of simple design, and one in which the spring elements constituting the electrical contact members are mechanically secured to the switch body in such a position that they are electrically connected into the flashlight circuit merely by the screw attachment of the switch assembly to the barrel of the flashlight. Further, by the manufacture of the switch, the complete assembly with its only electrical connections constituting the mounting screws can be effectively sealed against moisture and the barrel of the flashlight is similarly so sealed. Simplicity of assembly is also achieved.

BRIEF DESCRIPTION OF THE DRAWINGS

A more complete understanding of this invention may be had by reference to the following detailed description and by reference to the drawing in which:

FIG. 1 is a side view of a flashlight designed particularly for police and military use incorporating my invention;

FIG. 2 is a perspective view of the switch assembly in accordance with my invention;

FIG. 3 is a vertical sectional view through the switch assembly of FIG. 2, taken along lines 3—3;

FIG. 4 is an exploded view of the switch assembly of FIG. 2;

FIG. 5 A, B and C are three simplified views of this invention showing the three operating conditions of the switch of FIGS. 1 and 2;

FIG. 6 is an enlarged fragmentary vertical sectional view of the screw mounting details in accordance with this invention; and FIG. 7 is an enlarged fragmentary perspective view of a switch contact in accordance with this invention showing its relationship to the mounting screw.

DETAILED DESCRIPTION OF THE INVENTION

Now referring to FIG. 1 showing a typical flashlight 10 which is incorporated in this invention, the flashlight 10 includes a base cap 11 which secures the outer end of the hollow barrel 12 and provides a recess for storage of an additional lamp. The barrel 12 includes a switch assembly 13 extended generally parallel to the axis of the barrel 12 which terminates at a head 14 containing a lamp and reflector assembly. To all intents and purposes, the assembly of FIG. 1 appears to constitute a standard flashlight. The significant difference is the use of the improved switch 13 appearing in more detail in FIG. 2. It includes a body assembly 15 having a pair of side protective wings 16 and 17 which extend above the body and protect a thumb slider 20 from inadvertant movement. The body 15 includes a pair of ledges or platforms 21 and 22 at the front and rear having respective openings 23 and 24 therethrough which serve for mounting of the switch assembly to the barrel 12 of the flashlight 10 of FIG. 1. The underside of the switch assembly 15, not shown in FIG. 2, may be flat or it may be contoured to match the barrel 12 surface.

Of great significance and barely visible in FIG. 2 is the fact that there are a pair of tabs 30 and 31 which extend through the respective opening 23 and 24 and overlie the respective platform 21 and 22. Since the opening 23 and 24 receive the securing means, for example, a screw or rivet for the switch, the tabs 30 and 31 are in position to be in direct electrical contact with any metal fastener. Also, as may be seen more clearly in connection with FIGS. 3, 4 and 7, the tabs 30 and 31 have connection portions 32 and 33, best seen in FIG. 4. As may be seen in FIGS. 4 and 6, connecting portions 32 and 33 extend along the one wall of the respective openings 23 and 24. Thus, the tab 30, with its associated connection portion 32 and the tab 31 with its associated connection portion 33, will engage mechanically and electrically any metal fastener passing through the respective opening 23 and 24. By this means, electrical contact may be transferred from the switch assembly to the flashlight proper. Moreover, the tabs are mechanically secured to the switch body 15.

This arrangement is visible more clearly in FIGS. 3 and 6. The tabs 30 and 31 overlie the platform 21 or 22 so that the fastening means, such as screw 40, contacts the connecting means 32 and the underside of the head of screws 40 and 41 bears directly against the upper surface of the tab 30 and 31. Effective electrical contact is thereby achieved.

Where the openings 23 and 24 are small enough in diameter and a screw fastener is used, the threads of screws 40 and 41 will bite into the connecting portions 32 and 33 to provide even more effective electrical contact. This redundant connection is extremely important.

FIGS. 3 and 4 also illustrate more clearly the fact that the tabs 30 and 31 constitute actual integral continuations of the switch contact members 42 and 43 which are overlying leaf springs.

Also, the configuration of the slider 20 is visible in FIGS. 3 and 4. It includes basically a domed thumb engaging portion 20*a*which passes through a rectangular opening 50 in the body 15, best seen in FIG. 2, and a planar portion 20*b* which underlies the switch body 15 and carries a protuberance 52 which is the actual switch operator. When slider 20 is moved forward, to the right in the drawing, protuberance 52 forces a ramp portion 53 of the contact 43 into engagement with the spring contact 42 to close the electrical circuit. Another feature of this invention is apparent in FIG. 3. The thumb slider 20, when in the OFF position, need only be depressed to provide momentary electrical contact closure. When the downward pressure is released, the momentary contact is opened. Therefore, in the OFF position, signalling may be accomplished employing this switch without the need to move the slider 20 to any intermediate position. The three operating positions of the switch are illustrated in FIG. 5 with FIG. 5A constituting the OFF position with the two spring contacts 42 and 43 out of engagement. In FIG. 5B, the slider has been moved downward and has brought the contact spring 43 into momentary engagement with the contact spring 42. In FIG. 5C, the slider 20 has been advanced to the right in the drawing as is apparent and the protuberance 52 is now operative to hold the two contact springs 43 and 42 into engagement and the flashlight ON.

FIG. 7 illustrates in more particularity the relationship of the spring contacts 42 and 43 to the fastening screws 40 and 41. It should be noted that the tab portion 30 of the spring contact 42 is directly under the position of the head of the screw 40 and its connection portion 42 is engaging the threads of screw 40. It is also particularly apparent from FIG. 7 that tab 30 and its connection portion 32 are formed integrally by punching and bending from the metal strip constituting the spring contact 42 and therefore is produced at virtually the same cost encountered in punching to provide an opening for the fastening screw 40. One other factor of this invention which should be apparent is that it is necessary to insulate one of the two screws from the conducting body of a metal flashlight. In such case, a collar or sleeve 60 of insulating material is used. In this case, as illustrated in FIGS. 4 and 6, the opening through the barrel 12 which receives screw 40 must therefore be large enough to receive the sleeve 60 as well.

It is therefore seen in accordance with this invention that I have produced an improved unitary switch assembly which the simple mechanical steps of mechanically attaching the switch to the flashlight electrically engages it as well. Also, the interior may be sealed merely by the addition of a rubber gasket on the underside.

The above described embodiments of this invention are merely descriptive of its principles and are not to be considered limiting. The scope of this invention instead shall be determined from the scope of the following claims including their equivalents.

What is claimed is:

1. A switch assembly for flashlights and the like comprising an elongated body of insulation material including portions defining a pair of mounting holes therethrough;

the upper surface of said body having an access opening for a switch operator;

the underside of said body including a recess communicating with said access opening;

a pair of resilient strip conductive members in spaced superimposed position and constituting the switching elements of the switch assembly;

a switch operator positioned in said recess and including a portion extending through said access opening;

said operator being positioned over said conductive members wherein one position said operator biases said conductor members together and in a second position, allows said conductive members to separate thereby opening electrical connection therebetween;

said conductive members each including an integral tab portion extending in respective mounting holes of said body whereby electrical connection to said switch may be made by means of conductive fasteners passing through said mounting holes and fastening said body to a support structure.

2. The combination in accordance with claim 1 wherein said integral tab portions of said resilient strip conductive members extend through respective mounting holes of said body and each including a respective reentrant portion overlying said body thereby said conductive members are mechanically secured to said body by said reentrant portions prior to insertion of any fasteners in said mounting hole.

3. The Combination in accordance with claim 2 wherein said tab portions comprise integral portions of said conductor formed into generally inverted L shapes.

4. The combination in accordance with claim 2 wherein said conductive members comprise a pair of leaf springs.

* * * * *